US007410554B2

(12) United States Patent
Davenport

(10) Patent No.: US 7,410,554 B2
(45) Date of Patent: Aug. 12, 2008

(54) UNIQUE MODULAR CONSTRUCTION FOR USE AS A FORMING FABRIC IN PAPERMAKING OR TISSUE OR NONWOVENS

(75) Inventor: Francis L. Davenport, Ballston Lake, NY (US)

(73) Assignee: Albany International Corp., Albany, NY (US)

( * ) Notice: Subject to any disclaimer, the term of this patent is extended or adjusted under 35 U.S.C. 154(b) by 421 days.

(21) Appl. No.: 10/985,639

(22) Filed: Nov. 11, 2004

(65) Prior Publication Data

US 2006/0096729 A1 May 11, 2006

(51) Int. Cl.
*D21F 1/10* (2006.01)
*B32B 5/26* (2006.01)
*D03D 3/04* (2006.01)

(52) U.S. Cl. ..... 162/348; 162/903; 442/240; 139/425 A

(58) Field of Classification Search ..... 162/348, 162/358.1, 358.2, 900, 902–904; 428/57, 428/193; 139/383 A, 425 A, 383 AA; 156/195; 442/239–241

See application file for complete search history.

(56) References Cited

U.S. PATENT DOCUMENTS 4,501,303 A 2/1985 Osterberg
5,360,518 A 11/1994 McCarthy et al.
5,360,656 A 11/1994 Rexfelt et al.
5,713,399 A 2/1998 Collette et al.
5,826,627 A 10/1998 Seabrook et al.
5,840,637 A 11/1998 Denton et al.
5,888,915 A 3/1999 Denton et al.
5,967,195 A 10/1999 Ward
6,162,518 A 12/2000 Korfer
6,265,048 B1 * 7/2001 Rydin et al. ..... 428/121
6,350,336 B1 * 2/2002 Paquin ..... 156/93
6,723,208 B1 * 4/2004 Hansen ..... 162/358.2
2001/0027593 A1 10/2001 Paquin et al.
2003/0183358 A1 * 10/2003 Yook ..... 162/358.2
2004/0118545 A1 6/2004 Bakken et al.

FOREIGN PATENT DOCUMENTS

EP 1 063 349 A 12/2000

* cited by examiner

*Primary Examiner*—Eric Hug
(74) *Attorney, Agent, or Firm*—Frommer Lawrence & Haug LLP; Ronald R. Santucci

(57) ABSTRACT

A forming fabric including a sheet contact layer of woven material and a base layer formed of a layer of spiral turns formed by a spirally-wound material strip, the material strip having a width which is smaller in width than the forming fabric, the longitudinal axis of the spiral turns making an angle with said machine direction of the fabric. The sheet contact layer and the base layer are laminated to one another to form a single fabric.

35 Claims, 2 Drawing Sheets

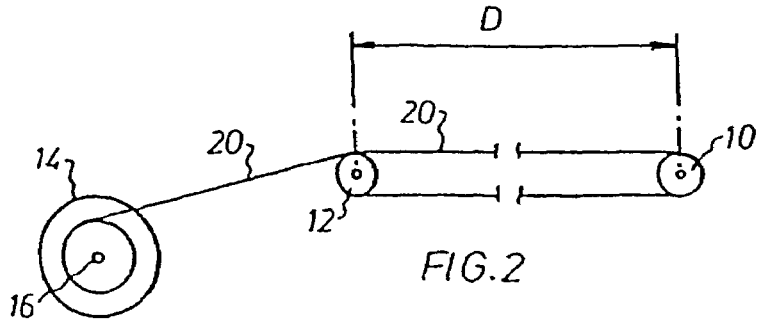
FIG. 2
FIG. 3
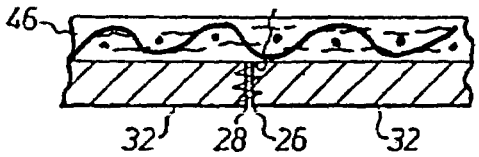
FIG. 4
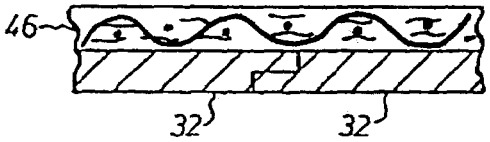
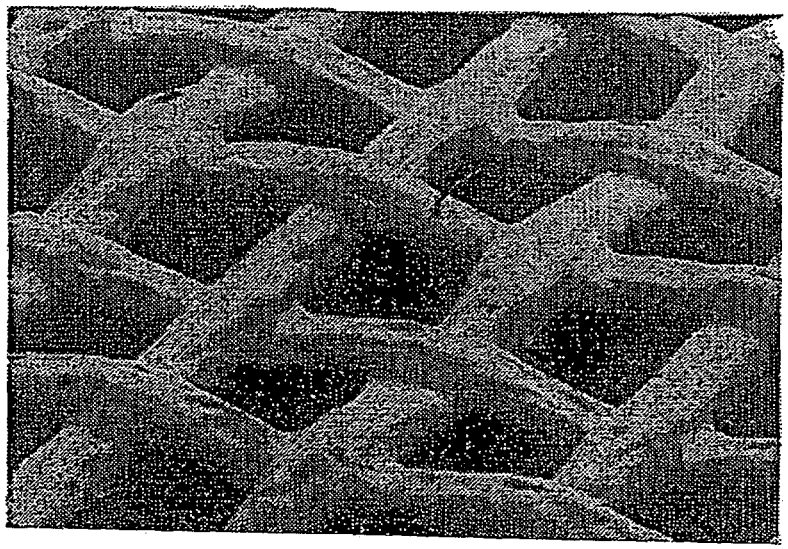
Fig 5

UNIQUE MODULAR CONSTRUCTION FOR USE AS A FORMING FABRIC IN PAPERMAKING OR TISSUE OR NONWOVENS

BACKGROUND OF THE INVENTION

1. Field of the Invention

The present invention relates to the papermaking arts. More specifically, the present invention relates to forming fabrics for the forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process, which proceeds at considerable speeds. That is to say, the fibrous slurry is continuously deposited onto the forming fabric in the forming section, while a newly manufactured paper sheet is continuously wound onto rolls after it exits from the dryer section.

Among others, the properties of surface smoothness, absorbency, strength, softness, and aesthetic appearance are important for many products when used for their intended purpose.

Papers and tissue towel can be produced using a variety of processes. Conventional manufacturing machines include a delivery of the suspension of cellulosic fiber onto one or between two forming fabrics. This partially dewatered sheet is then transferred to a press fabric, which dewaters the sheet further as it transfers the sheet to the surface of a large dryer. The fully dried sheet is removed from the dryer surface and wound onto rolls for further processing.

An alternative process employs a through air drying (TAD) unit either replacing the press fabric above with another woven fabric which transfers the sheet from the forming fabric to the through air drying fabric. It is this fabric, which transfers the sheet to a TAD cylinder where hot air is blown through the wet cellulosic sheet, simultaneously drying the sheet and enhancing sheet bulk and softness.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of their functions, as implied above, is to form and convey the paper product being manufactured to the press section or next papermaking operation.

The upper surface of the forming fabric, to which the cellulosic fibrous web is applied, should be as smooth as possible in order to assure the formation of a smooth, unmarked sheet. Quality requirements for forming require a high level of uniformity to prevent objectionable drainage marks.

Of equal importance, however, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric that is usually woven from monofilament yarns and may be single-layered or multi-layered. The yarns are typically extruded from any one of several synthetic polymeric resins, such as polyamide and polyester resins, metal or other material suitable for this purpose and known by those of ordinary skill in the paper machine clothing arts.

The design of forming fabrics typically involves a compromise between the desired fiber support and fabric stability. A fine fabric having small diameter yarns and a high number of yarns in both the MD and CD directions may provide the desired paper surface and fiber support properties, but such design may lack the desired stability resulting in a short fabric life. By contrast a coarse fabric having larger diameter yarns and few of them may provide stability and long life at the expense of fiber support and the potential for marking. To minimize the design tradeoff and optimize both support and stability, multi-layer fabrics were developed. For example, in double and triple layer fabrics, the forming side is designed for fiber support while the wear side is designed for strength, stability, drainage, and wear resistance.

In addition, triple layer designs allow the forming surface of the fabric to be woven independently of the wear surface. Because of this independence, triple layer designs can provide a high level of fiber support and an optimum internal void volume. Thus, triple layers may provide significant improvement in drainage over single and double layer designs.

Currently known triple layer fabrics typically consist of two fabrics, the forming layer and the wear layer, held together by binding yarns. The binding is extremely important to the overall integrity of the fabric. One problem with triple layer fabrics has been relative slippage between the two layers, which breaks down the fabric over time. In addition, the binding yarns can disrupt the structure of the forming layer resulting in marking of the paper. See e.g., Osterberg (U.S. Pat. No. 4,501,303), the contents of which are incorporated herein by reference.

In order to further improve the integrity of the fabric and sheet support, triple layer fabrics were created incorporating binder pairs. These pairs of binders are incorporated into the structure in a variety of weave patterns and picking sequences. See e.g., Seabrook et al. (U.S. Pat. No. 5,826,627) and Ward (U.S. Pat. No. 5,967,195), the contents of which are incorporated herein by reference.

Another problem inherent to papermaking fabrics is wear caused by abrasion between the fabric and the various surfaces of the papermaking machine on which the fabric is installed. As mentioned above, the fabric is installed as a continuous belt, which is rotated through the papermaking machine at considerable speeds. This constant high-speed motion causes significant wear, which necessitates frequent and costly replacement of the fabrics.

Further, the current methods for the production of laminate forming fabrics are cumbersome, time consuming, and very expensive. Moreover, to effectuate a smooth surface as desired often complex and intricate seaming or joining is necessary. In such an instance the machine directions (MD) yarns of a flat woven fabric are rewoven back into the fabric at each end to effectuate a continuous layer. This is time consuming, expensive and can be a weak part of the fabric. Further, this area is prone to damaging or marking the paper.

Since forming, press, and dryer fabrics all need to be made at a variety of lengths and widths, alternative methods are sought to expedite manufacture of these products.

For example, most press fabrics today are woven endless, or in a continuous loop. This requires more expensive and different size weaving looms, some as wide as 32 meters.

In response to this need to produce press fabrics in a variety of lengths and widths more quickly and efficiently, press fabrics have been produced in recent years using a spiral technique disclosed in commonly assigned U.S. Pat. No. 5,360,656 to Rexfelt et al., the teachings of which are incorporated herein by reference.

U.S. Pat. No. 5,360,656 shows a base fabric comprising at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom, which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Further, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine) direction, is the result. The lateral edges of the woven base fabric are then trimmed to render them parallel to its longitudinal (machine) direction. The angle between the machine direction of the woven base fabric and the helically continuous seam may be relatively small, that is, typically less than 10°. By the same token, the lengthwise (warp) yarns of the woven fabric strip make the same relatively small angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filling) yarns of the woven fabric strip align with the longitudinal (machine) or transverse (cross-machine) directions of the woven base fabric.

In the method shown in U.S. Pat. No. 5,360,656, the woven fabric strip is wound around two parallel rolls to assemble the woven base fabric. It will be recognized that endless base fabrics in a variety of lengths and widths may be provided by spirally winding a relatively narrow piece of woven fabric strip around the two parallel rolls, the length of a particular endless base fabric being determined by the length of each spiral turn of the woven fabric strip, and the width being determined by the number of spiral turns of the woven fabric strip. The prior necessity of weaving complete base fabrics of specified lengths and widths to order may thereby be avoided. Instead, a loom as narrow as 20 inches (0.5 meters) could be used to produce a woven fabric strip, but, for reasons of practicality, a conventional textile loom having a width of from 40 to 60 inches (1.0 to 1.5 meters) may be preferred.

U.S. Pat. No. 5,360,656 also shows a fabric comprising a base fabric having two layers, each composed of a spirally wound strip of woven fabric. Both layers take the form of an endless loop, one being inside the endless loop formed by the other. Preferably, the spirally wound strip of woven fabric in one layer spirals in a direction opposite to that of the strip of woven fabric in the other layer. That is to say, more specifically, the spirally wound strip in one layer defines a right-handed spiral, while that in the other layer defines a left-handed spiral. In such a structure, the lengthwise (warp) yarns of the woven fabric strip in each of the two layers make relatively small angles with the longitudinal (machine) direction of the woven base fabric, and the lengthwise (warp) yarns of the woven fabric strip in one layer make an angle with the lengthwise (warp) yarns of the woven fabric strip in the other layer. Similarly, the crosswise (filling) yarns of the woven fabric strip in each of the two layers make relatively small angles with the transverse (cross-machine) direction of the woven base fabric, and the crosswise (filling) yarns of the woven fabric strip in one layer make an angle with the crosswise (filling) yarns of the woven fabric strip in the other layer. In short, neither the lengthwise (warp) nor the crosswise (filling) yarns of the woven fabric strip in either layer align with the longitudinal (machine) or transverse (cross-machine) directions of the base fabric. Further, neither the lengthwise (warp) nor the crosswise (filling) yarns of the woven fabric strip in either layer align with those of the other.

Since the Rexfelt '656 fabric is the base for a press fabric, the two or more layers are held together, or laminated through the use of needled batt fibers. Batt fiber is not used as a component of a fabric in the forming section of a paper machine.

Accordingly, there is a need to produce a cost effective and efficient means of producing a forming fabric having both a smooth contact surface, effective drainage, and sufficient fabric support.

SUMMARY OF THE INVENTION

It is an object of the present invention to produce a forming fabric having a simplified manufacturing process having a reduced production time, capital cost, and production cost.

It is yet another object of the present invention to produce a forming fabric without requiring complex seaming as compared to the forming fabrics of the prior art.

It is a further object of the present invention to produce a forming fabric that has superior resistance to separation as compared to those of the prior art.

It is yet another object of the present invention to produce a multi-layer forming fabric with excellent sheet forming and drainage characteristics.

Still further, it is an object of the present invention to produce a forming fabric that can be installed in an endless fashion having the aforementioned superior characteristics over the prior art.

Accordingly, a forming fabric is described including a base or a top contact layer which is preferably a single layer of woven material having a substantially smooth texture and a base layer formed of a layer of spiral turns formed by a spirally-wound material strip, the material strip having a width which is smaller in width than the forming fabric with the longitudinal axis of the spiral turns making an angle with said machine direction of the fabric. The sheet contact layer and the base layer are laminated to one another to form a single fabric.

The various features of novelty, which characterize the invention, are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated.

BRIEF DESCRIPTION OF THE DRAWINGS

For a more complete understanding of the invention, reference is made to the following description and accompanying drawings, in which:

FIG. 2 is a side view according to FIG. 1;

FIG. 3 is a side view of a base layer and a sheet contact layer according to one aspect of the present invention;

FIG. 4 is a side view of a base layer and a sheet contact layer according to a further aspect of the present invention; and FIG. 5 is a magnified view of a plain weave top layer having 100% bondable yarns according to one aspect of the present invention.

DETAILED DESCRIPTION OF THE PRESENT INVENTION

Figure 1:
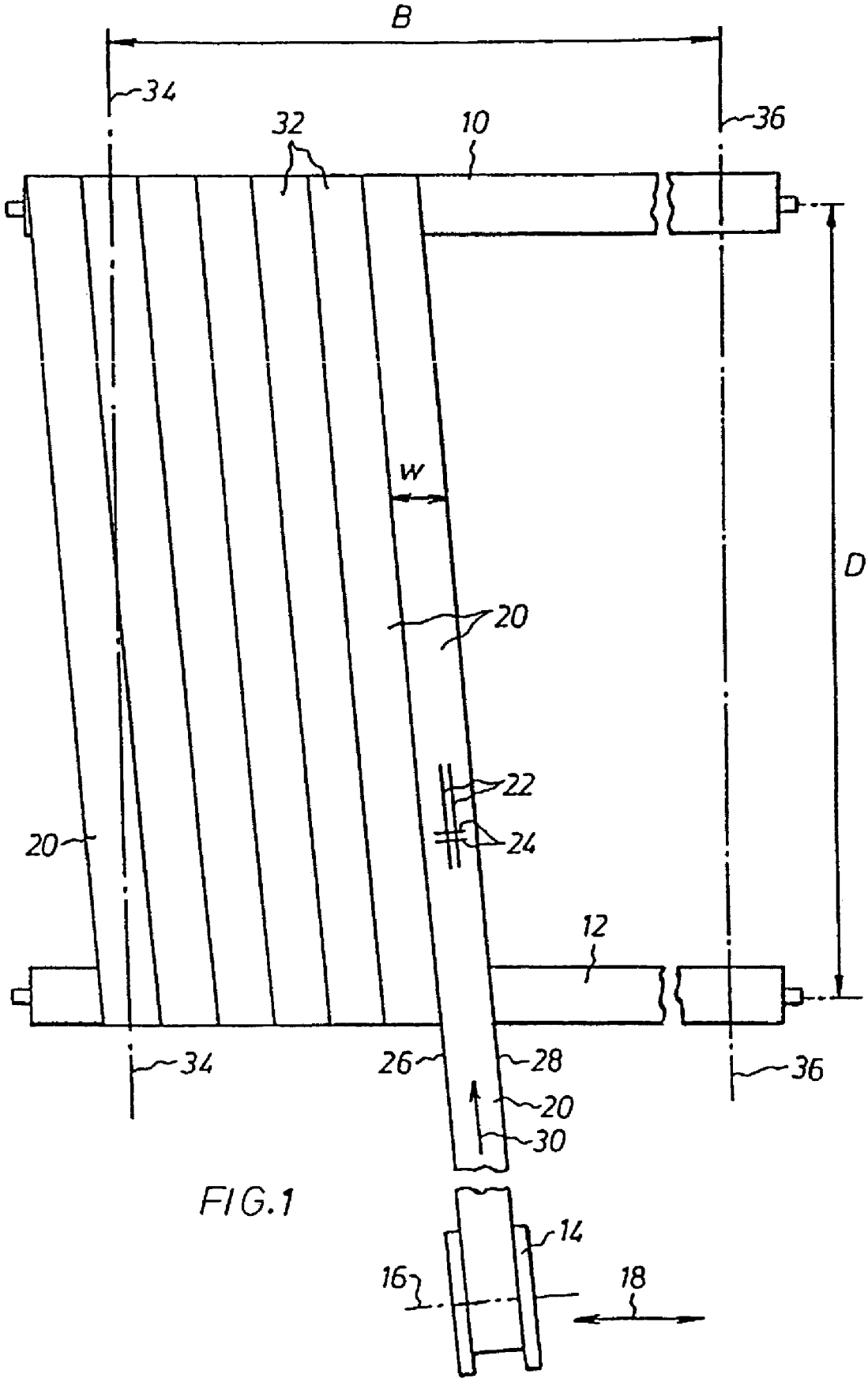
FIG. 1 is a schematic top view illustrating a method of manufacturing the base layer according to the present invention.

The present invention is directed to a papermaker's fabric and more particularly to a forming fabric. The forming fabric is comprised at least two separate base layers. The first base layer known as a top base layer or sheet contact layer may be formed by conventional endless or tubular-weaving techniques, or flat weaving and is typically a plain weave structure. One of skill in the art will appreciate that other structures could also be used without departing from the scope of the present invention. The top base layer is the layer of the forming fabric that will contact the cellulosic fibrous web, formed by the deposition of a fibrous slurry thereon. As such, it is desirable that this surface be very smooth and uniform.

When using a flat woven top base layer, it is necessary to seam or join the ends of the fabric to form an endless fabric. This can be accomplished with the simple joining techniques that are well known to those skilled in the art. Since it is a single layer fabric, joining is simpler and speedier than when a multiple layer fabric must be joined since all the yarns must be woven back into the fabric body. Naturally, when using a top base layer that has been formed endless or woven tubular, no seaming is necessary.

A second base layer is formed separately from the first. The second base layer is the bottom base layer and may be formed using strips of woven, knitted, or braided material, nonwoven mesh or an array of MD and/or CD yarns according to the teachings of U.S. Pat. No. 5,360,656.

The two base layers are then laminated together by gluing, ultrasonic welding, fusing, or bonding or by other means known to those skilled in the art to form a single papermaker's fabric.

Forming of the bottom base layer is performed as shown in FIGS. 1 and 2, to which reference is now made. FIGS. 1 and 2, illustrate two rotatably mounted rolls 10, 12 having parallel axes spaced from each other by a distance D equivalent to approximately two times the desired fabric length for an "endless" fabric. At the side of one roll 12, there is provided a supply reel 14 rotatably mounted about an axis 16 and displaceable parallel to the rolls 10 and 12, as indicated by the double arrow 18.

The supply reel 14 accommodates a supply roll of for example a woven fabric strip of yarn material 20 having a width w. The woven strip 20 has in known manner two mutually orthogonal thread systems consisting of longitudinal threads and cross threads schematically represented in FIG. 1 at 22 and 24, respectively. Further, the strip 20 has two longitudinal edges 26 and 28, the edges of which are e.g. uniformly cut to a desired width before the strip 20 is wound on to the supply reel 14.

The supply reel 14 is initially applied at the left-hand end of the roll 12 before being continuously displaced to the right at a synchronized speed. As the supply reel 14 is displaced sideways, the strip 20 is dispensed, as indicated by an arrow 30, to be wound spirally about the rolls 10, 12 into a "tube" having a closed circumferential surface. The strip 20 is placed around the rolls 10, 12 with a certain pitch angle, which in the illustrated embodiment is assumed to be so adapted to the strip width w, the distance D between the roll axes and the diameters of the rolls 10, 12, that the longitudinal edges 26, 28 of adjacent "spiral turns" 32 are placed edge to edge (see FIG. 3), so as to provide a smooth transition between the spiral turns 32.

The number of spiral turns 32 placed on the rolls 10, 12 is dependent on the desired width B on the final fabric. After the spiral winding operation is completed, the edges of the resulting fabric are cut along the dash-dot lines 34, 36 in FIG. 1 to obtain the width B. The length of the final fabric essentially is twice the distance D between the roll axes and can therefore easily be varied by changing the distance D.

To prevent the spiral turns 32 already wound on the rolls 10, 12 from shifting on the rolls, it is possible, if so required, for instance to fix the first turn 32 in the longitudinal direction of the rolls.

FIG. 3 schematically shows how the end edges 26, 28 of two juxtaposed spiral turns 32 are in edge-to-edge relationship and joined by sewing, as schematically indicated at 44. FIG. 3 also schematically illustrates a top base layer 46. It should be noted however that in depicting the two separate base layers, for ease of understanding FIGS. 3 and 4 represent the top base layer substantially thicker than actual dimensions as compared to the bottom base layer.

FIG. 4 shows an alternative embodiment according to which adjacent longitudinal edge portions of adjoining spiral turns are arranged overlappingly, the edges having a reduced thickness so as not to give rise to an increased thickness in the area of transition.

For a forming fabric, a single layer spirally made like that of FIG. 1 can be used as the bottom base. This single layer of fabric can be a multilayer design, similar to a multi-layer weave fabric, that is flat woven and wound into an endless form in a manner well known to skilled artisans and as set forth in U.S. Pat. No. 5,360,656.

A second layer of spirally wound strips of fabric can also be utilized if required. If a second layer is used, it is spiraled in a direction opposite to that of the first spirally wound layer, also as taught in the '656 patent.

According to one aspect of the present invention a spirally wound layer of base layer is laminated to an endless woven or flat woven top base fabric layer to form a multi-layer fabric. For a multilayer fabric, it is further possible in a known manner to use different thread spacings/structures for the different layers in order to obtain, for example, special dewatering-enhancing properties. One example of a top base layer is shown in FIG. 5.

In any event, several methods may be used to join the adjacent turns of spiraled material to each other. These same methods may also be used to laminate the top and bottom base layers to each other. These methods include but are not limited to the use of ultrasound to bond selective points, adhesives/glues, and low melt yarn components. One method of laminating the top and bottom layers by the ultrasonic bonding is discussed in U.S. Pat. No. 5,713,399, which is incorporated herein by reference.

Further, when incorporating the use of a permeable low melt sheath or film, the "sheath technique," which is known to those skilled in the art, the layers and sheath (or "laminate") can be exposed to heat with or without pressure to bond the layers together.

Another technique suitable for the invention is the use of bondable or meltable yarns. Such yarns may be used in only the MD direction, in only the CD direction, or in both the MD and CD directions. Either layer or all layers may contain these bondable yarns. For example, polyurethane coated yarns could be used, like the yarns disclosed in U.S. Pat. No. 5,360,518, as well as the bicomponent yarns of U.S. Pat. No. 5,840,637, both of which are incorporated herein by reference. Furthermore, yarns comprising specific materials such as commercially available MXD6 resin are preferably utilized. MXD6 yarns are unique in that the yarns are made of 100% of the resin, and can be partially melted on the outer surface causing it to bond to other yarns it touches. Yet the properties, for instance porosity, do not change even when partially melted. Further aspects and advantages of yarns such as MXD6 are taught by U.S. Pat. No. 5,506,891, which is incorporated herein by reference.

The advantages of using yarns made of MXD6 and similar resins including an overall ease in the processing of a multilayer fabric. Further, complex weaving and joining and the use of binder yarns can be eliminated. Subsequently there is no binder wear, and surface defects are minimized. Still further advantages include the ability to select the weave patterns and yarn counts independently from the other fabric layers.

Either or both the top layer and the bottom layer may be formed using the bondable yarns. FIG. 5 shows a sheet contact layer formed of bondable yarns following the application of heat and/or pressure. In accordance with the present invention, when the top and bottom layers are formed of such yarns and are exposed to heat, with or without pressure, they bond together to form a single fabric.

The papermaker's fabric of the present invention has superior resistance to delamination as compared to those of the prior art. Further, this construction simplifies the manufacturing process and reduces production time, capital cost, and production cost. Much of this savings is created by the elimination of complex seaming procedures required by the multilayer forming fabrics of the prior art. By utilizing the spiral wound base layer, the top layer can be preferably a single layer woven fabric eliminating complex seaming. Still further, the fabric as described herein can still be installed in an endless fashion. Moreover, this laminated structure eliminates many quality and uniformity concerns caused by complex weave patterns with binder yarns to join to separate layer together. Any time a binder yarn weaves over another yarn there is the risk that the other yarn would be pulled down out of plane, causing surface defects, which can cause unacceptable sheet marking. Finally, successful manufacture using this inventive technique reduces both weaving and expensive joining costs.

While the present invention has been particularly shown and described in conjunction with preferred embodiments thereof, it will be readily appreciated by those of ordinary skill in the art that various changes may be made without departing from the spirit and scope of the invention. Therefore, it is intended that the appended claims be interpreted as including the embodiments described herein as well as all equivalents thereto.

What is claimed is:

1. A papermaker's forming fabric, comprising:

a sheet contact layer of a full-width woven material having a substantially smooth texture;

a base layer formed of a layer of spiral turns formed by a spirally-wound material strip, said material strip having a width which is smaller in width than the papermaker's fabric, the longitudinal axis of the spiral turns making an angle with said machine direction of the fabric, and wherein the sheet contact layer and the base layer are laminated to one another to form a single fabric.

2. The papermaker's fabric of claim 1, wherein the sheet contact layer is formed of a plain weave.

3. The papermaker's fabric of claim 1, wherein the sheet contact layer is woven endless.

4. The papermaker's fabric of claim 1, wherein the sheet contact layer is a woven single layer fabric joined to form an endless fabric.

5. The papermaker's fabric of claim 1, wherein the material strips are bonded to one another by at least one of the bonding techniques selected from the group consisting of ultrasonic bonding, adhesive bonding, bonding through low melt materials and bonding through the use of bondable yarns.

6. The papermaker's fabric of claim 1, wherein the sheet contact layer and the base layer are bonded to one another by at least one of the bonding techniques selected from the group consisting of ultrasonic bonding, adhesive bonding, bonding through low melt materials and bonding through the use of bondable yarns.

7. The papermaker's fabric of claim 6, wherein the sheet contact layer comprises bondable yarns.

8. The papermaker's fabric of claim 6, wherein the base layer comprises bondable yarns.

9. The papermaker's fabric of claim 6, wherein the sheet contact layer and the base layer comprise bondable yarns.

10. The papermaker's fabric of claim 6, wherein the bondable yarns of the sheet contact layer are selected from a group yarns consisting of only the MD direction, in only the CD direction, and in both the MD and CD directions.

11. The papermaker's fabric of claim 6, wherein the bondable yarns of the base layer yarns are selected from a group consisting of only the MD direction, only the CD direction, and in both the MD and CD directions.

12. The papermaker's fabric of claim 1, wherein said material strip is selected from a group consisting of woven strips of MD and CD yarns, knitted material, braided material, nonwoven mesh, and an array of MD and/or CD yarns.

13. The papermaker's fabric of claim 1, wherein adjacent longitudinal edge portions of the spirally-wound material strip are so arranged that said layer has a substantially constant thickness over the entire width of the fabric.

14. The papermaker's fabric of claim 13, wherein said adjacent longitudinal edge portions of the spirally-wound material strip are arranged edge to edge.

15. The papermaker's fabric of claim 13, wherein said adjacent longitudinal edge portions of the spirally-wound material strip overlap.

16. The papermaker's fabric of claim 1, wherein said layer of spiral turns further comprises an edge joint provided between adjacent longitudinal edge portions of the spirally-wound material strip.

17. The papermaker's fabric of claim 16, wherein said adjacent longitudinal edge portions of the spirally-wound material strip are bonded by a method selected from the group consisting of meltbonding, sewing, ultrasonic bonding, and gluing to provide said edge joint.

18. A method of producing a papermaker's forming fabric comprising the steps of:

providing a sheet contact layer of a full-width woven material having a substantially smooth texture;

providing a base layer formed by a spirally-wound material strip, said material strip having a width which is smaller in width than the papermaker's fabric, the longitudinal axis of the spiral turns making an angle with said machine direction of the fabric; and laminating the sheet contact layer and the base layer to one another to form a single fabric.

19. The method of claim 18, comprising a step of forming the sheet contact layer by plain weave.

20. The method of claim 18, comprising a step of forming the sheet contact layer by endless weaving.

21. The method of claim 18, comprising a step of weaving the sheet contact layer.

22. The method of claim 21, comprising a step of joining the sheet contact layer to form an endless fabric.

23. The method of claim 18, comprising a step of bonding the material strips to one another by at least one of the bonding techniques selected from a group consisting of ultrasonic bonding, adhesive bonding, bonding through low melt materials and bonding through the use of bondable yarns.

24. The method of claim 18, wherein the sheet contact layer and the base layer are bonded to one another by at least one of the bonding techniques selected from a group consisting of ultrasonic bonding, adhesive bonding, bonding through low melt materials and bonding through the use of bondable yarns.

25. The method of claim 24, wherein the sheet contact layer comprises bondable yarns.

26. The method of claim 24, wherein the base layer comprises bondable yarns.

27. The method or claim 24, wherein the sheet contact layer and the base layer comprise bondable yarns.

28. The method of claim 24, wherein the bondable yarns of the contact sheet layers are selected from a group consisting of only the MD direction, only the CD direction, and both the MD and CD directions.

29. The method of claim 24, wherein the bondable yarns of the base layer yarns are selected from a group consisting of only the MD direction, only the CD direction, and both the MD and CD directions.

30. The method of claim 18 wherein said material strip is selected from the group consisting of a woven strip of MD and CD yarns, knitted material, braided material, nonwoven mesh, and an array of MD and/or CD yarns.

31. The method of claim 18 comprising the step of arranging adjacent longitudinal edge portions of the spirally-wound material strip so that said layer has a substantially constant thickness over the entire width of the fabric.

32. The method of claim 31, comprising the step of arranging said adjacent longitudinal edge portions of the spirally-wound material edge to edge.

33. The method of claim 31, overlapping said adjacent longitudinal edge portions of the spirally-wound material strip.

34. The method of claim 18, wherein said layer of spiral turns further comprises an edge joint provided between adjacent longitudinal edge portions of the spirally-wound material strip.

35. The method of claim 34, wherein said adjacent longitudinal edge portions of the spirally wound material are bonded in a method selected from the group consisting of heat bonding sewing, ultrasonically bonding, and gluing together to provide said edge joint.

* * * * *